US005735228A

United States Patent [19]

Huang

[11] Patent Number: 5,735,228

[45] Date of Patent: Apr. 7, 1998

[54] BARGE LINKING SYSTEM USING FLEXIBLE CONNECTORS

[75] Inventor: Tsongshih Huang, Westlake Village, Calif.

[73] Assignee: The United States of America as represented by the Secretary of the Navy, Washington, D.C.

[21] Appl. No.: 816,927

[22] Filed: Mar. 13, 1997

[51] Int. Cl.[6] ..... B63B 35/44

[52] U.S. Cl. ..... 114/266; 114/249

[58] Field of Search ..... 114/230, 249, 114/266, 267, 263, 251, 264

[56] References Cited

U.S. PATENT DOCUMENTS

| | | | |
|---|---|---|---|
| 3,799,100 | 3/1974 | Marriner | 114/266 |
| 3,983,830 | 10/1976 | Morgan | 116/266 |
| 4,321,882 | 3/1982 | Sluys | 114/266 |
| 4,335,670 | 6/1982 | Skaalen et al. | 114/249 |

*Primary Examiner*—Ed L. Swinehart
*Attorney, Agent, or Firm*—David S. Kalmbaugh; Melvin J. Sliwka

[57] ABSTRACT

A barge linking system which includes a pair of flexible connector assemblies stored on board a rear pontoon of a pair pontoons to be connected at sea. Each flexible connector assembly has a forward housing and a rear housing which are connected by a shear pin and rotate about the shear pin. Attached to the front end of the forward housing is flexible rubber sleeve which encases a substantial portion of a chain sling. The front end of the chain sling, which extends from the rubber sleeve, has a master link which allows the chain sling to be connected to a cable from a winch on board the forward pontoon. The rear housing of the flexible connector assembly has a chain shackle which allows the rear housing to be connected to a cable from a winch on board the rear pontoon. The forward housing has a pair of slots which align with a pair of slots in the forward pontoon, while the rear housing has a pair of slots which align with a pair of slots in the rear pontoon. A first guillotine collar is inserted into the aligned slots of the forward housing and first pontoon to secure the forward pontoon to the forward housing. A second guillotine collar is inserted into the aligned slots of the rear housing and rear pontoon to secure the forward pontoon to the forward housing of the connector assembly.

14 Claims, 7 Drawing Sheets

BARGE LINKING SYSTEM USING FLEXIBLE CONNECTORS

BACKGROUND OF THE INVENTION

1. Field of the Invention

This invention relates generally to floating structures, such as pontoons and barges, that are attached, preferably, in an end-to-end or side by side fashion to form a continuous train that may be towed, for example, by a barge, tug or similar ocean going vessels. More specifically, the present invention is concerned to apparatus for drawing together, aligning and linking together two or more pontoons, barges or the like, while on rough water or a turbulent sea, to form a continuous train that may be towed by an ocean going vessel.

2. Description of the Prior Art

The connecting and locking together of pontoons, barges, or the like presents a difficult, dangerous and a labor intensive task. Pontoons and barges are often connected together on land or on the deck of an amphibious support ship and thereafter the completed assembly of pontoons or barges is deployed at sea by a means such as a crane.

A second alternative is to connect the pontoons or barges in a sheltered inlet, cove, sea port or any place where the water is generally calm, when available, and then tow the completed train of pontoons or barges to a desired location.

These approaches of the past, however, have serious limitations to the efficient and effective connecting and locking together of pontoons and barges for use in deep or open water ocean environments where the ocean may be rough. When pontoons are assembled on the deck of a ship, significant deck space is required to assemble the pontoons, cranes are required for the assembly and placement of the pontoons in the ocean and there is also a large manpower requirement. The deck crews which assemble the pontoons and barge trains are exposed to hanging cables, guide wires, chains and the like as well as swinging pontoons and barges often weighing tens of tons, while they manually guide the pontoons or barges together and activate the connectors that secure the pontoons or barges together. Work performed by crew members under these conditions can lead to serious injury or even death.

In the alternative, pontoons and barges may be assembled on a calm sea surface or in the confines of a calm sheltered area, such as a sea port, or cove when the seas are rough and very turbulent with extremely high waves of several feet. However, a calm area may not be readily available near an operational site.

Using dry tow to assemble barges is vessel dependent and wet tow to assemble barges is time consuming.

Furthermore, the assembling of pontoons and barge trains in rough and turbulent seas can place the assemblers in a unsafe environment. This environment includes tensioned and travelling cables and guide wires, and banging and bobbing pontoons can create a hazardous situation which can lead to serious injury or death as assemblers manually activate connectors between adjacent pontoons.

In addition, in the past pontoons and the like have been assembled at sea using rigid connectors. The use of rigid connectors to assemble pontoons provides for a continuous level deck surface since the relative position of all pontoons is fixed, which allows maximum flexibility in cargo layout, handling and storage.

However, the use of rigid connectors to assemble pontoons has limitations. For example, when rigid connectors are used to assemble pontoons the connectors must be able to resist significant bending stresses and other forces placed on the connectors. Further, rigid connectors may require special hull geometry to allow for alignment of the connectors during connection with an adjoining pontoon or barge. Other factors which limit the use of rigid connectors in an ocean going environment are: (1) the need for delicate jacking hardware and sophisticated rigging systems when using rigid connectors to couple adjacent pontoons and (2) heavy wire ropes to resist dynamic loads.

Accordingly, there is a need for a relatively simple in design, yet highly effective connector which allows pontoons or barges to be coupled together at sea under any condition including extreme turbulence where waves are several feet in height. Further, the connector should minimize the risk of injury to the user and facilitate the drawing together, aligning and locking together of two adjoining pontoons or barges.

SUMMARY OF THE INVENTION

The barge linking system of the present invention overcomes some of the disadvantages of the prior art including those mentioned above in that it comprises a relatively simple, yet highly effective connecting apparatus which allows pontoons or barges to be coupled together at rough seas including extreme turbulence.

The barge linking system of the present invention includes a pair of flexible connector assemblies which are stored on board the rear pontoon of a pair of pontoons to be connected at sea. Each flexible connector assembly has a forward housing/assembly and a rear housing/assembly which are connected by a shear pin and rotate about the shear pin. Attached to the front end of the forward housing is a flexible rubber sleeve which encases a substantial portion of a chain sling. The front end of the chain sling, which extends from the flexible rubber sleeve, has a master link which allows the chain sling to be connected to a cable from a winch on board the forward pontoon of the pair of pontoons to be connected at sea.

Similarly, the rear housing of the flexible connector assembly has a chain shackle which allows the rear housing to be connected to a cable from a winch on board the rear pontoon.

The forward housing of each connector assembly has a pair of slots which are adapted to align with a pair of slots in the support structure of the forward pontoon, while the rear housing has a pair of slots which are adapted to align with a pair of slots in the support structure of the rear pontoon.

When the slots of the rear housing align with the slots of the rear pontoon a first guillotine collar is inserted into the aligned slots to secure the rear pontoon to the rear housing of the connector assembly. In a like manner, when the slots of the forward housing align with the slots of the forward pontoon a second guillotine collar is inserted into the aligned slots to secure the forward pontoon to the forward housing of the connector assembly. This, in turn, couples the forward pontoon to the rear pontoon allowing for rotational movement of the forward pontoon and the rear pontoon about the shear pin of each flexible connector assembly of the barge linking system.

DETAILED DESCRIPTION OF THE PREFERRED EMBODIMENT

Figure 1:
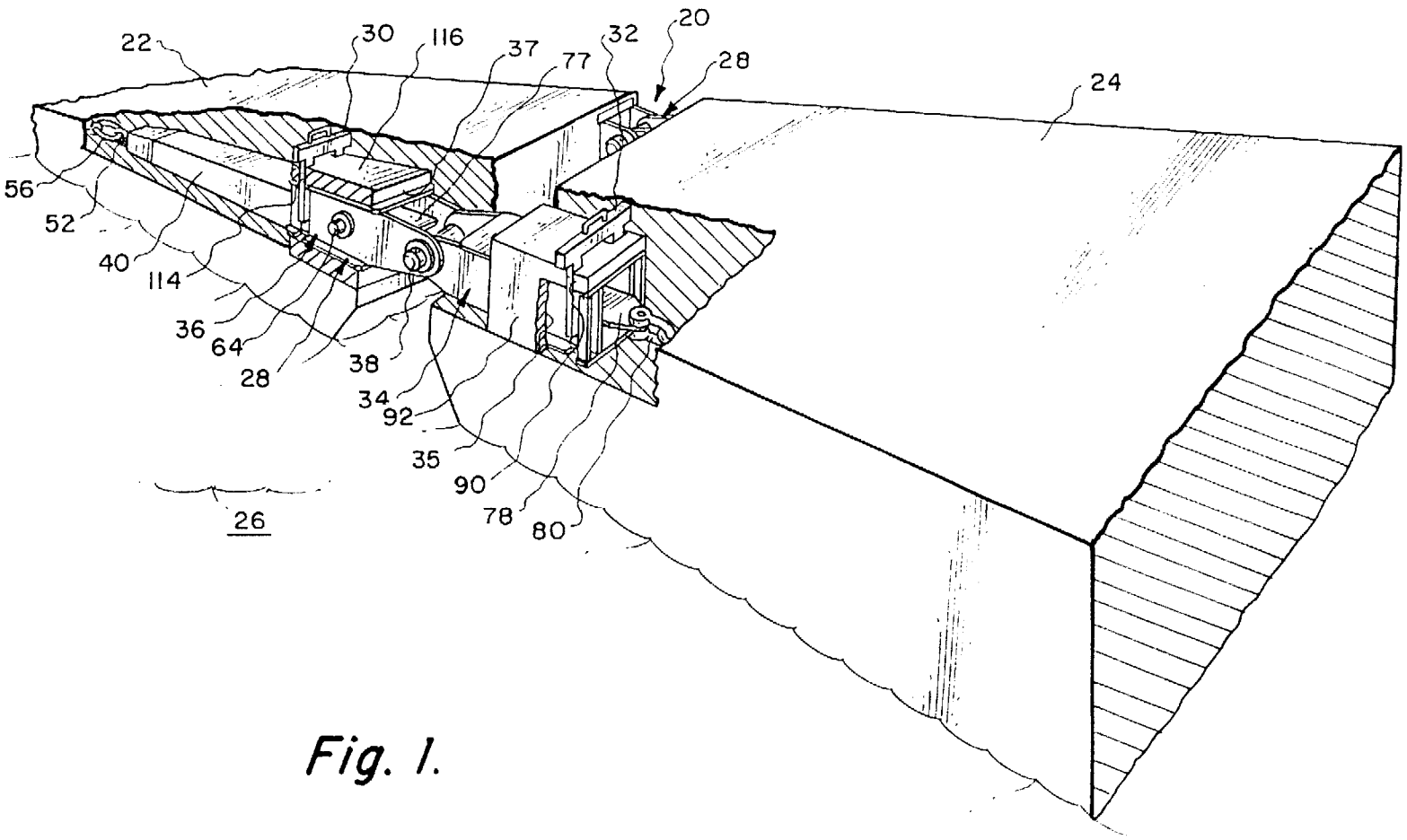
FIG. 1 is a perspective view illustrating the barge linking system of the present invention being deployed to connect adjacent barges.

The preferred embodiment of the present invention is illustrated in FIGS. 1 to 8 of the drawings wherein like parts are represented by like reference numerals in so far as it is possible and practical to do so.

Figure 2:
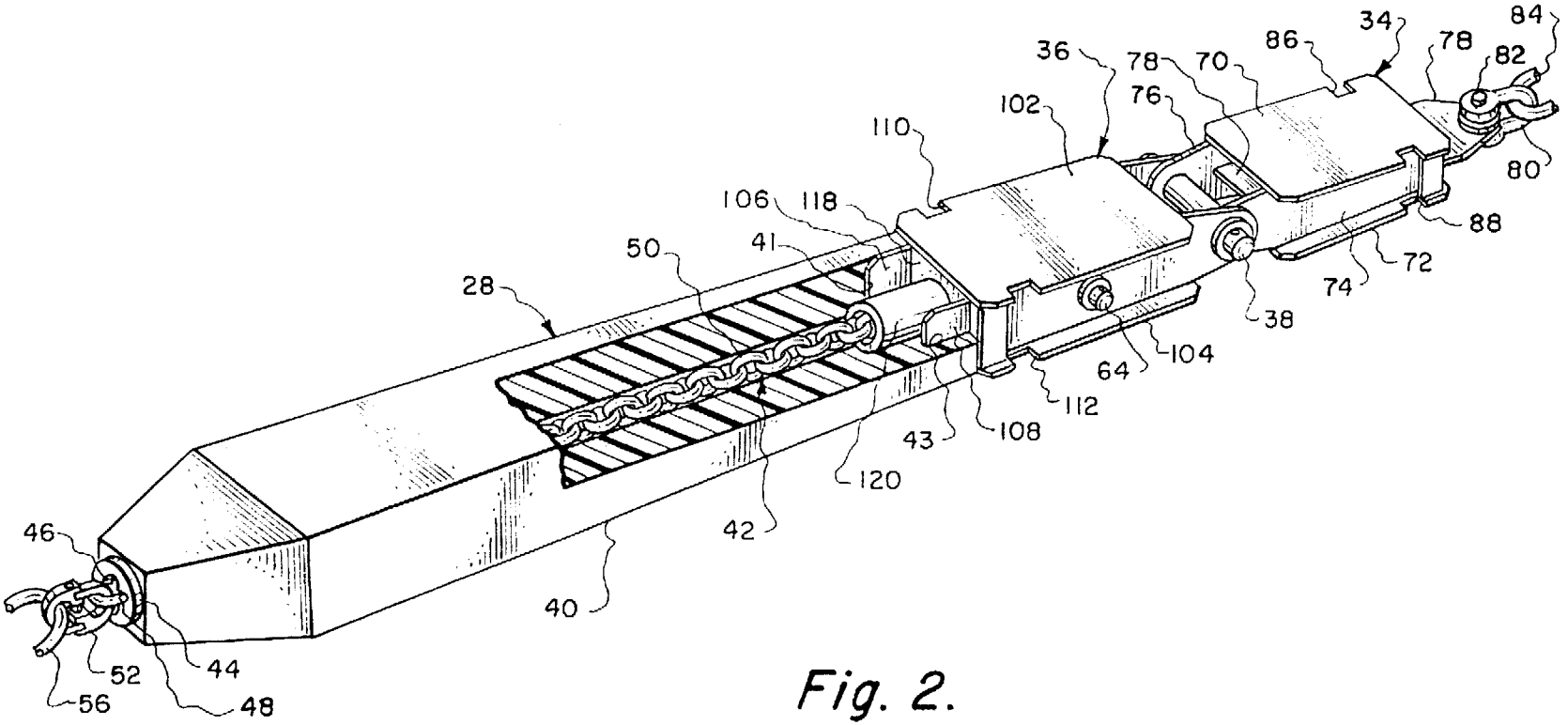
FIG. 2 is a perspective view, in partial section, illustrating a flexible connector assembly of the barge linking system of FIG. 1.

Referring to FIGS. 1 and 2, there is shown a barge linking system, designated generally by the reference numeral 20, which is adapted for use with adjoining pontoons 22 and 24 allowing for the relatively simple coupling of pontoons 22 and 24 in an ocean going environment 26 where waves may be extremely high and the waters very turbulent. It should be understood barge linking system 20 is also adapted for use other ocean going vessels and platforms which are used in the transportation goods such as barges and causeways.

Barge linking system 20 includes a pair of identical flexible connector assemblies 28, one of which couples the right rear of pontoon 22 to the right front of pontoon 24 and the other one of which couples the left rear of pontoon 22 to the left front of pontoon 24. In a like manner, other pontoons or barges in a train would be coupled together using a pair of flexible connector assemblies 28 as depicted in FIGS. 1 and 2.

As shown in FIG. 1, the flexible connector assembly 28 positioned on the left side of pontoons 22 and 24 is secured in a locked position to pontoons 22 and 24 by a pair of identical chain stop guillotines collars 30 and 32. In a like manner, the flexible connector assembly 28 on the right side of pontoons 22 and 24 is secured by a pair of chain stop guillotines collars which are identical to guillotine collars 30 and 32.

When in the engaged position illustrated in FIG. 1, a rear housing/assembly 34 of flexible connector assembly 28 fits within an elongated opening 35 located adjacent the left front corner of pontoon 24. Similarly, when in the engaged position a forward housing/assembly 36 of flexible connector assembly 28 fits within an elongated opening 37 aligned with opening 35 and located adjacent the left rear corner of pontoon 22. The flexible connector assembly 28 positioned near the right side of pontoons 22 and 24 also fits within aligned elongated openings (not shown) adjacent the right front corner of pontoon 24 and the right rear corner of pontoon 22.

Figure 3:
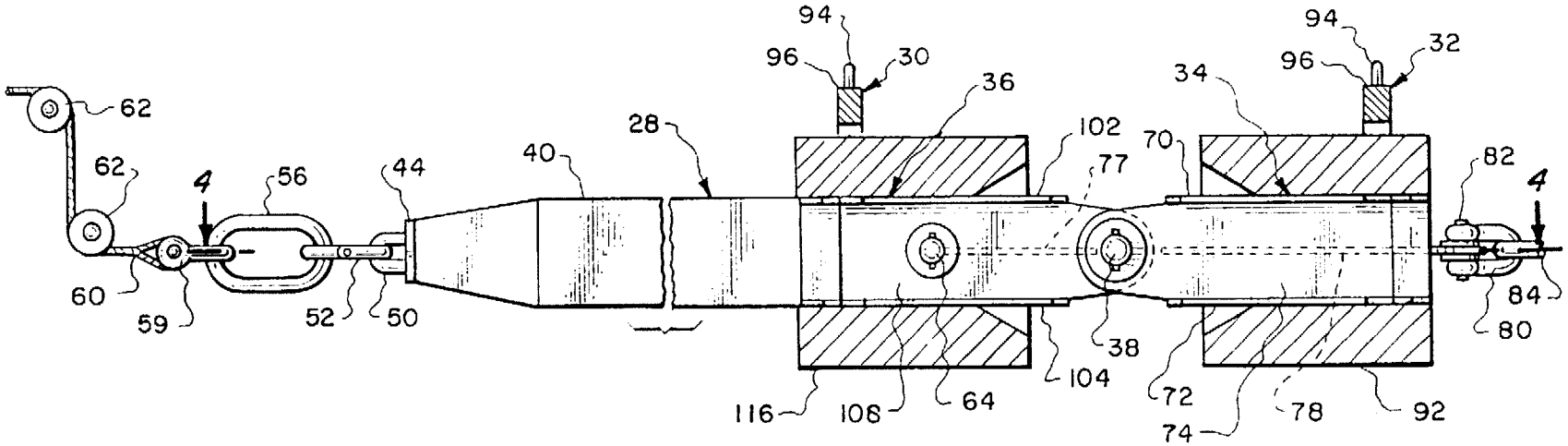
FIG. 3 is a side view, in partial section, of the flexible connector assembly of FIG. 2.
Figure 4:
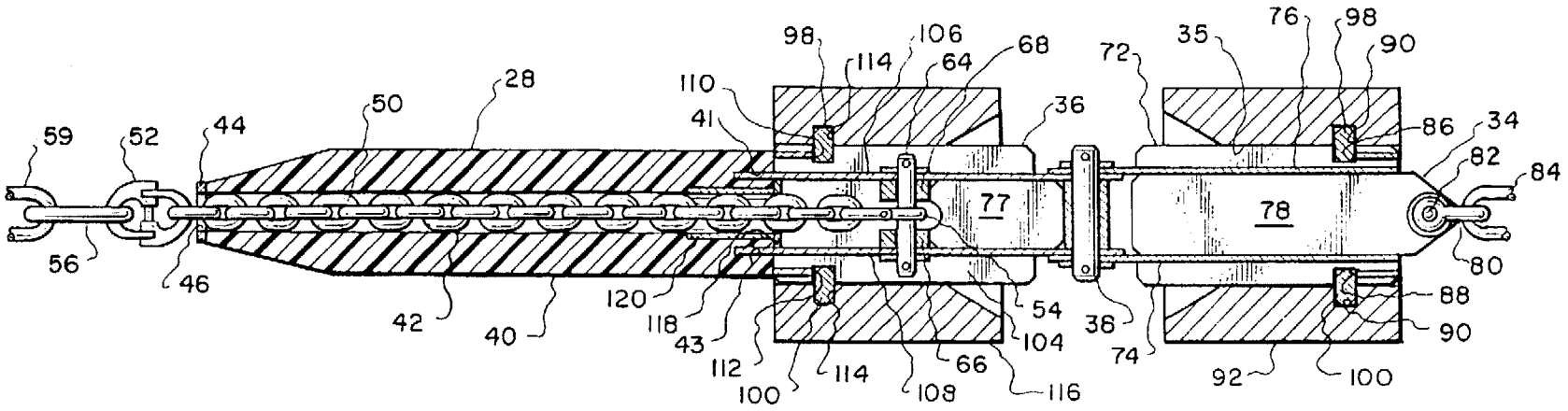
FIG. 4 is a cross section view taken on line 4—4 of FIG. 3 of the flexible connector assembly of FIG. 2.
Figure 5:
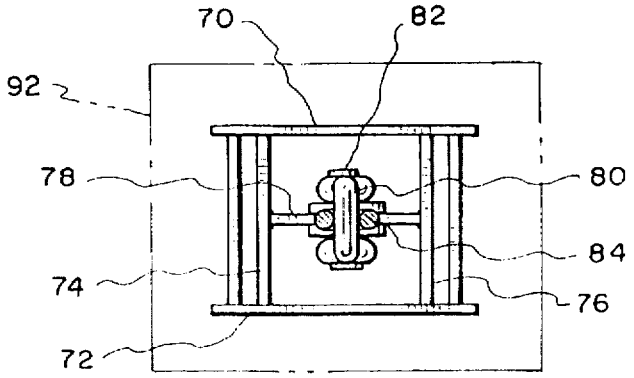
FIG. 5 is an end view of the flexible connector assembly of FIG. 2.
Figure 7:
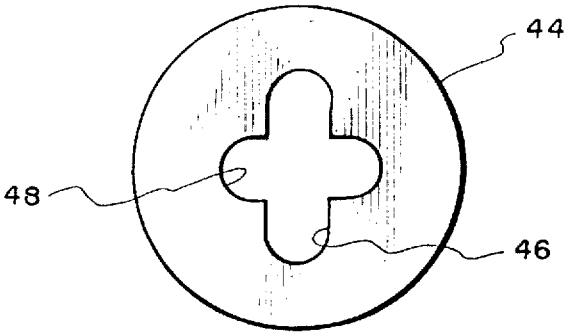
FIG. 7 is a front view of the chain support bar for the flexible connector assembly of FIG. 2.

Referring now to FIGS. 1, 2, 3, and 4, each flexible connector assembly 28 of system 20 includes rear housing/assembly 34, forward housing/assembly 36 and a shear pin 38 which rotationally couples forward housing 36 to rear housing 34 allowing for angular movement of rear housing 34 and forward housing 36 about shear pin 38. Attached to the front end of forward housing 36 is a flexible sleeve 40 which may be fabricated from rubber, polyurethane or any other flexible material which is resistant to abrasion, wear and the corrosive effects of seawater. Flexible sleeve 40 has a substantial portion of a chain sling 42 mounted or encased therein. As shown in FIGS. 3 and 4, the forward portion of flexible sleeve 40 is angled inward, that is flexible sleeve 40 is tapered near its front end for easy alignment of flexible sleeve 40 with elongated opening 37 of pontoon 22 when flexible sleeve 40 is pulled or forced into opening 37 of pontoon 22.

Figure 8:
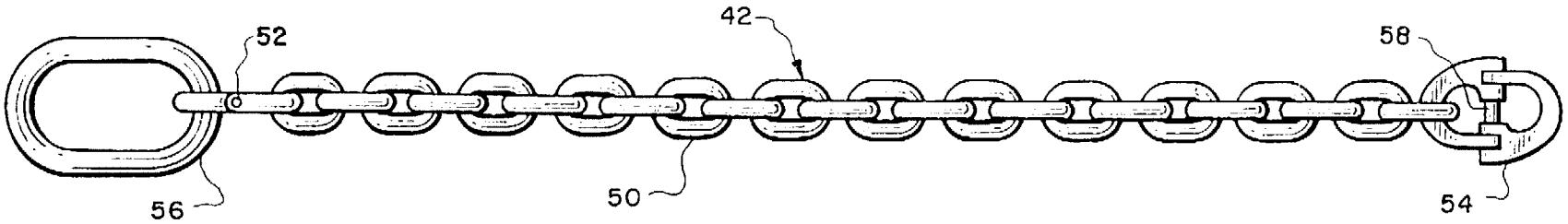
FIG. 8 is a side view of the chain sling for the flexible connector assembly of FIG. 1.

Referring to FIGS. 3, 4, 7 and 8, attached to the front end of flexible sleeve 40 is a chain sling support member 44, which is circular in configuration. Chain sling support member 44 has a pair of slots 46 and 48 with slot 46 being perpendicular to slot 48. The forward end of chain sling 42 extends from flexible sleeve 40 through slots 46 and 48 of chain sling support member 44. As is best illustrated in FIG. 8, chain sling 42 includes a chain link 50 comprising 24 links fabricated from steel, a pair of steel connecting links 52 and 54 attached respectively to the front and rear ends of chain link 50 and an elongated steel master link 56 attached to connecting link 52 of chain sling 42. Each connecting link 52 and 54 has a swivel pin 58 which allows for angular movement of the rear portion of the link 52 or 54 with respect to the front portion of the connecting link 52 or 54. The master link 56 of chain sling 42 is adapted to receive a chain shackle 59 and a cable 60 from a winch 62, while the connecting link 54 at the rear end of chain sling 42 is coupled to a chain pin 64 which is supported by support arms 66 and 68 mounted within forward housing 36 of flexible connector assembly 28.

Referring to FIGS. 2, 3, 4 and 5, rear housing 34 of flexible connector assembly 28 comprises a flanged top plate 70, a flanged bottom plate 72 and a pair of side walls 74 and 76 which extend perpendicularly upward from the flanged bottom plate 72 to the flanged top plate 70. Rear housing 34 also has a centrally located reinforcement plate 78 which extends from side wall 74 to side wall 76. The rear portion of reinforcement plate 76, which extends rearward from housing 34, has a chain shackle 80 secured thereto by a chain pin 82. Chain pin 82 provides for rotational movement of chain shackle 80 allowing a chain shackle 84 and its associated cable from a winch (not illustrated) to be attached to the chain shackle 80 and not damage the shackle 80.

Figure 6:
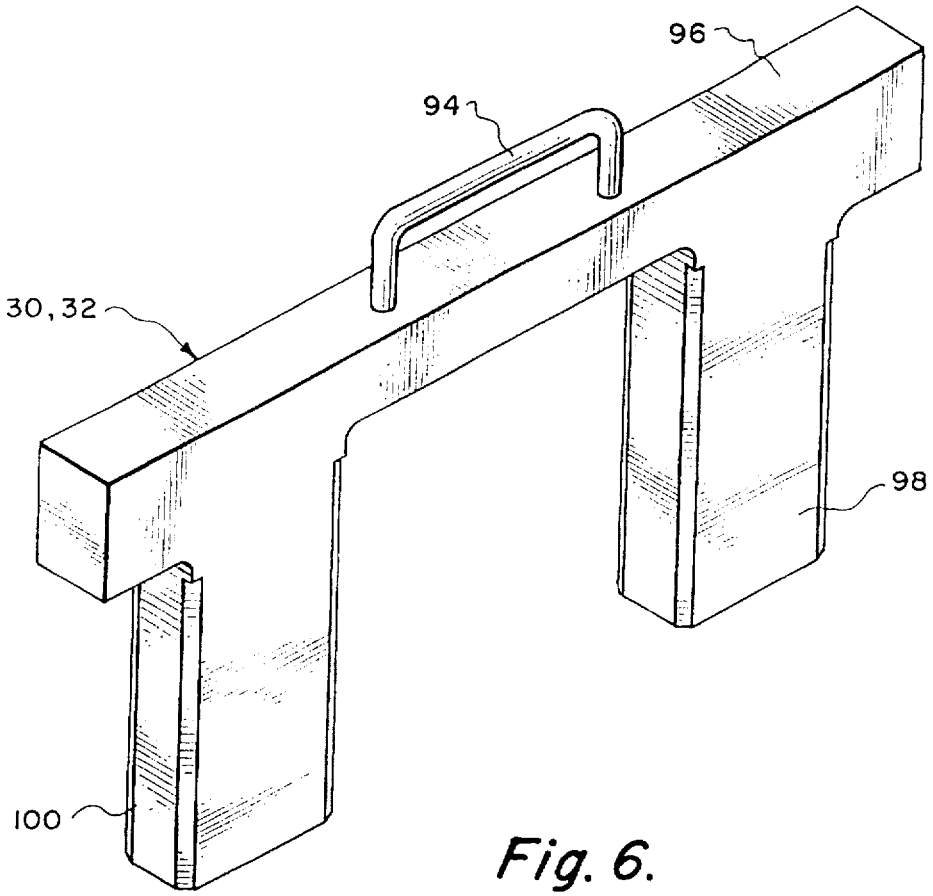
FIG. 6 is perspective view of the chain stop guillotine collars used with the flexible connector assembly of FIG. 2.

Referring to FIGS. 1, 4 and 6, rear housing 34 also has a pair of aligned slots 86 and 88 near its rear which are adapted to receive collar 32 (FIG. 6). Pontoon 24 also has a pair of slots 90 located within in its support structure 92 positioned to align with the slots 86 and 88 of the rear housing 34 of flexible connector assembly 28. When the user of barge linking system 20 aligns the slots 86 and 88 of rear housing 34 with the slots 90 of the support structure 92 of pontoon 24 the user may insert collar 32 into the aligned slots 86, 88 and 90 to secure the rear housing 34 of flexible connector assembly 28 to pontoon 24 in the manner shown in FIG. 1.

As shown in FIG. 6 each collar 30 and 32 of FIG. 1 includes a handle 94 attached to its top surface 96 and a pair of elongated locking members 98 and 100 which are generally rectangular shaped and which extend downward from the upper portion of collar 30 and collar 32. The locking members 98 and 100 of collar 32, for example, when inserted into aligned slots 86, 88 and 90 lock the rear housing 34 of flexible connector assembly 28 to pontoon 24.

Referring now to FIGS. 1, 2, 3, 4 and 6, the front housing 36 of flexible connector assembly 28 comprises a flanged top plate 102, a flanged bottom plate 104 and a pair of side walls 106 and 108 which extend perpendicularly upward from the bottom plate 104 to the top plate 102. There is also provided a support plate 77 which is centrally located within front housing 36 and which is approximately parallel to flanged top plate 102 and flanged bottom plate 104. Forward housing 36 also has a pair of aligned slots 110 and 112 near its front which are adapted to receive collar 30 (FIG. 6).

Pontoon 22 also has a pair of slots 114 located within in its support structure 116 positioned to align with the slots 110 and 112 of the forward housing 36 of flexible connector assembly 28. When the user of barge linking system 20 aligns the slots 110 and 112 of forward housing 36 with the slots 114 of the support structure 116 of barge 22 the user may insert collar 30 into the aligned slots 110, 112 and 114 to secure the front housing 36 of flexible connector assembly 28 to barge 22 in the manner shown in FIG. 1.

Located at the front end of forward housing 36 of flexible connector assembly 28 is a pipe support member 118 which has a pipe 120 affixed thereto. A rear portion of chain sling 42 passes through pipe 120 which provides partial support for chain sling 42 and aligns chain sling 42 with the slots 46 and 48 of chain sling support member 44. In addition, pipe 120 provides support for flexible sleeve 40 which prevents flexible sleeve 40 from being dislodged from forward housing 36.

As is best illustrated by FIGS. 2, 3 and 4 a rear portion of sides walls 106 and 108 (which extends beyond plate 102) are positioned inside of a front portion of side walls 74 and 76 (which extends beyond plate 70). This allows shear pin 38 to be mounted within aligned apertures (not illustrated) within side walls 74, 76, 106 and 108 to provide for rotational movement of housing 34 and 36 about shear pin 38. A front portion of side walls 106 and 108 respectively extend into slots 41 and 43 within the flexible sleeve 40.

At this time it should be noted that the hinge joint formed by shear pin 38 of flexible connector assembly 28 substantially reduces bending stress on pontoons 22 and 24 caused by ambient waves in ocean going environment 26. This allows the pontoon hulls for pontoons 22 and 24 to be designed and fabricated at a much higher structural efficiency.

It is to be noted that the following discussion relates to the operation of the flexible connector assembly 28 near the left front of pontoon 24 when pontoons 22 and 24 are to be joined as shown in FIG. 1. It should be understood that this discussion is also applicable to the operation of the flexible connector assembly 28 near the right front of pontoon 24 when pontoons 22 and 24 are to be joined as shown in FIG. 1.

Referring to FIGS. 1–8, prior to joining in the manner illustrated in FIG. 1, pontoons 22 and 24 may be separated a considerable distance (10–200 feet or more) at sea in turbulent water. Chain shackle 59 and cable 60 from winch 62 pass through elongated opening 37 of pontoon 22 and over ocean going environment 26 to master link 56 of chain sling 42 which is located on board pontoon 24. A user/assembler positioned on pontoon 24 may then connect chain shackle 59 and cable 60 to master link 56 of chain sling 42 prior to activating winch 62.

It should be noted that prior to use each of the pair of identical flexible connector assemblies 28 is stored on board the pontoon 24. One of the pair of flexible connector assemblies 28 is stored in a fixed position within the elongated opening 35 which is located adjacent the left front corner of pontoon 24, while the other of the pair of flexible connector assemblies 28 is stored in a fixed position within an elongated opening (not shown) which is located adjacent the right front corner of pontoon 24. Each flexible connector assembly 28 is held in this fixed position by a guillotine collar 32 which is inserted into a pair of rearward slots (not shown) within the support structure 92 of pontoon 24.

The following discussion will be with respect to the flexible connector assembly 28 positioned adjacent the left side of pontoon 24, although it should be understood that the discussion also applies to the flexible connector assembly 28 on the right side of pontoon 24. Prior to activating winch 62 the guillotine collar 32 for flexible connector assembly 28 on the left side of pontoon 24 is removed therefrom and chain shackle 59 is connected to master link 56 for the flexible connector assembly 28.

When winch 62 is activated the front portion of flexible connector assembly 28 on the left side of pontoon 24 is pulled from elongated opening 35 of pontoon 24 toward pontoon 22. When the slots 90 within support structure 92 of pontoon 24 align with the slots 86 and 88 of the rear housing 34 of flexible connector assembly 28, the user inserts collar 32 into the aligned slots 86, 88 and 90 to secure the rear housing 34 of flexible connector assembly 28 to pontoon 24 in the manner shown in FIG. 1.

Winch 62 continuous to draw cable 60 into elongated opening 37 of pontoon 22 pulling pontoon 24 closer to pontoon 22. Alignment of pontoons 22 and 24 can be increased and relative motion of pontoons 22 and 24 can be decreased by using tow vessels (not shown) coupled to pontoons 22 and 24 to place pontoons 22 and 24 under opposing tow.

Flexible sleeve 40 of flexible connector assembly 28 first enters opening 37 in the support structure 116 of pontoon 22, followed by the forward housing 36 of flexible connector assembly 28. When the slots 110 and 112 of forward housing 36 of connector assembly 22 align with the slots 114 of the support structure 116 of barge 22 the user may disengage winch 62 and then insert collar 30 into the aligned slots 110, 112 and 114 to secure the front housing 36 of flexible connector assembly 28 to barge 22 in the manner shown in FIG. 1. The unique combination of flexible sleeve 40 and shear pin 38 form a double joint which allows the forward portion of flexible connector assembly 28 to flex. This flexibility of assembly 28, in turn, allows the flexible sleeve 40 and forward housing 36 to be drawn into opening 37 in the support structure 116 of pontoon 22 under rough seas including extreme turbulence where motion changes of pontoon 22 are many and varied.

The winch, cable and chain shackle 84 connected to chain shackle 80 of flexible connector assembly 28 are used to return flexible connector assembly 28 to its initial or stored position within pontoon 24 after flexible connector assembly 28 is disconnected from pontoon 22 by removing collar 32 from pontoon 22 and also disconnecting master link 56 of chain sling 42 from chain shackle 59 of cable 60.

From the foregoing it may readily be seen that the present invention comprises a new, unique and exceedingly useful barge linking system which is a considerable improvement over the known prior art. Obviously many modifications and variations of the invention are possible in light of the above teachings. It is, therefore, to be understood that within the scope of the appended claims the invention may be practiced otherwise than as specifically described.

What is claimed is:

1. A pontoon linking system for connecting a first pontoon to a second pontoon in a seawater environment, said pontoon linking system having a pair of flexible connector assemblies, said pair of flexible connector assemblies connecting a rear portion of said first pontoon to a front portion of said second pontoon, each of said flexible connecter assemblies comprising:

a forward housing having a pair of slots, said forward housing being positioned within an elongated opening at the rear portion of said first pontoon when said first pontoon is connected to said second pontoon;

a rear housing coupled to said forward housing, said rear housing being positioned Within an elongated opening at the front portion of said second pontoon when said first pontoon is connected to said second pontoon;

a shear pin for coupling said forward housing to said rear housing, said shear pin allowing for a rotational movement of said forward housing and said rear housing around said shear pin;

a flexible sleeve attached to a front end of said forward housing, said flexible sleeve having a tapered front end and a chain sling support member attached to the tapered front end of said flexible sleeve, said chain sling support member having a pair of slots, a first of said pair of slots being perpendicular to a second of said pair of slots;

a chain sling mounted within said flexible sleeve, said chain sling having a rear end connected to said forward housing and a forward end extending through the pair of slots of said chain sling support member;

said pair of slots of said forward housing including a first and second slot, the first slot of said forward housing being aligned with a first slot within said first pontoon and the second slot of said forward housing being aligned with a second slot within said first pontoon when said first pontoon is connected to said second pontoon;

a first guillotine collar fitted within the first and second slots of said forward housing and the first and second slots of said first pontoon to secure said forward housing to said first pontoon;

said pair of slots of said rear housing including a first and second slot, the first slot of said rear housing being aligned with a first slot within said second pontoon and the second slot of said rear housing being aligned with a second slot within said second pontoon when said first pontoon is connected to said second pontoon; and a second guillotine collar fitted within the first and second slots of said rear housing and the first and second slots of said second pontoon to secure said rear housing to said second pontoon.

2. The pontoon linking system of claim 1 wherein said flexible sleeve is fabricated from rubber.

3. The pontoon linking system of claim 1 wherein said flexible sleeve is fabricated from a polyurethane flexible material.

4. The pontoon linking system of claim 1 wherein said chain sling has a master link affixed to the forward end thereof, the master link of said chain sling being adapted to connect said chain sling to a cable of a winch located on said first pontoon.

5. The pontoon linking system of claim 1 wherein said rear housing has a chain shackle rotatably coupled thereto, said chain shackle being adapted to connect said rear housing to a cable of a winch located on said second pontoon.

6. The pontoon linking system of claim 1 wherein said chain sling includes a chain link comprising twenty four links and a pair of connecting links, one of said pair of links being coupled to a front end of said chain link and the other of said pair of links being coupled to a rear end of said chain link.

7. A pontoon linking system for connecting a first pontoon to a second pontoon in a seawater environment, said pontoon linking system having a pair of flexible connector assemblies, said pair of flexible connector assemblies connecting a rear portion of said first pontoon to a front portion of said second pontoon, each of said flexible connecter assemblies comprising:

a forward housing having a pair of slots, said forward housing being positioned within an elongated opening at the rear portion of said first pontoon when said first pontoon is connected to said second pontoon;

a rear housing coupled to said forward housing, said rear housing being positioned within an elongated opening at the front portion of said second pontoon when said first pontoon is connected to said second pontoon;

a shear pin for coupling said forward housing to said rear housing, said shear pin allowing for a rotational movement of said forward housing and said rear housing around said shear pin;

a flexible sleeve attached to a front end of said forward housing, said flexible sleeve having a tapered front end and a chain sling support member attached to the tapered front end of said flexible sleeve, said chain sling support member having a pair of slots, a first of said pair of slots being perpendicular to a second of said pair of slots;

a chain sling mounted within said flexible sleeve, said chain sling having a rear end connected to said forward housing and a forward end extending through the pair of slots of said chain sling support member;

said chain sling having a master link affixed to the forward end thereof, the master link of said chain sling being adapted to connect said chain sling to a cable of a first winch located on said first pontoon;

said pair of slots of said forward housing including a first and second slot, the first slot of said forward housing being aligned with a first slot within said first pontoon and the second slot of said forward housing being aligned with a second slot within said first pontoon when said first pontoon is connected to said second pontoon;

a first guillotine collar fitted within the first and second slots of said forward housing and the first and second slots of said first pontoon to secure said forward housing to said first pontoon;

said pair of slots of said rear housing including a first and second slot, the first slot of said rear housing being aligned with a first slot within said second pontoon and the second slot of said rear housing being aligned with a second slot within said second pontoon when said first pontoon is connected to said second pontoon;

a second guillotine collar fitted within the first and second slots of said rear housing and the first and second slots of said second pontoon to secure said rear housing to said second pontoon; and a chain shackle rotatably coupled to said rear housing, said chain shackle being adapted to connect said rear housing to a cable of a second winch located on said second pontoon.

8. The pontoon linking system of claim 7 wherein said flexible sleeve is fabricated from rubber.

9. The pontoon linking system of claim 7 wherein said flexible sleeve is fabricated from a polyurethane flexible material.

10. The pontoon linking system of claim 7 wherein said chain sling includes a chain link comprising twenty four links and a pair of connecting links, one of said pair of links being coupled to a front end of said chain link and the other of said pair of links being coupled to a rear end of said chain link.

11. A pontoon linking system for connecting a first pontoon to a second pontoon in a seawater environment, said pontoon linking system having a pair of flexible connector assemblies, said pair of flexible connector assemblies connecting a rear portion of said first pontoon to a front portion of said second pontoon, each of said flexible connecter assemblies comprising:

a forward housing having a pair of slots, said forward housing being positioned within an elongated opening at the rear portion of said first pontoon when said first pontoon is connected to said second pontoon;

a rear housing coupled to said forward housing, said rear housing being positioned within an elongated opening at the front portion of said second pontoon when said first pontoon is connected to said second pontoon;

a shear pin for coupling said forward housing to said rear housing, said shear pin allowing for a rotational movement of said forward housing and said rear housing around said shear pin;

a flexible sleeve attached to a front end of said forward housing, said flexible sleeve having a tapered front end and a chain sling support member attached to the tapered front end of said flexible sleeve, said chain sling support member having a pair of slots, a first of said pair of slots being perpendicular to a second of said pair of slots;

a chain sling mounted within said flexible sleeve, said chain sling having a rear end connected to said forward housing and a forward end extending through the pair of slots of said chain sling support member;

said chain sling having a master link affixed to the forward end thereof, the master link of said chain sling-being adapted to connect said chain sling to a cable of a first winch located on said first pontoon;

said pair of slots of said forward housing including a first and second slot, the first slot of said forward housing being aligned with a first slot within said first pontoon and the second slot of said forward housing being aligned with a second slot within said first pontoon when said first pontoon is connected to said second pontoon;

a first guillotine collar fitted within the first and second slots of said forward housing and the first and second slots of said first pontoon to secure said forward housing to said first pontoon;

said pair of slots of said rear housing including a first and second slot, the first slot of said rear housing being aligned with a first slot within said second pontoon and the second slot of said rear housing being aligned with a second slot within said second pontoon when said first pontoon is connected to said second pontoon;

a second guillotine collar fitted within the first and second slots of said rear housing and the first and second slots of said second pontoon to secure said rear housing to said second pontoon;

said forward housing and said rear housing each having a flanged top plate, a flanged bottom plate and a pair of side walls extending perpendicularly upward from said flanged bottom plate to said flanged top plate;

said rear housing having a reinforcement plate which extends from a first of said pair of side walls to a second of said pair of side walls, a portion of said reinforcement plate extending rearward from said rear housing; and a chain shackle rotatably coupled to said portion of said reinforcement plate extending rearward from said rear housing, said chain shackle being adapted to connect said rear housing to a cable of a second winch located on said second pontoon.

12. The pontoon linking system of claim 11 wherein said flexible sleeve is fabricated from rubber.

13. The pontoon linking system of claim 11 wherein said flexible sleeve is fabricated from a polyurethane flexible material.

14. The pontoon linking system of claim 11 wherein said chain sling includes a chain link comprising twenty four links and a pair of connecting links, one of said pair of links being coupled to a front end of said chain link and the other of said pair of links being coupled to a rear end of said chain link.

* * * * *